US007383878B1

(12) United States Patent
Victor

(10) Patent No.: US 7,383,878 B1
(45) Date of Patent: Jun. 10, 2008

(54) MULTI-PART PLUNGER

(75) Inventor: Bruce M. Victor, Fort Lupton, CO (US)

(73) Assignee: Production Control Services, Inc., Frederick, CO (US)

( * ) Notice: Subject to any disclaimer, the term of this patent is extended or adjusted under 35 U.S.C. 154(b) by 308 days.

(21) Appl. No.: 10/803,373

(22) Filed: Mar. 18, 2004

Related U.S. Application Data

(60) Provisional application No. 60/456,667, filed on Mar. 18, 2003.

(51) Int. Cl.
*E21B 33/12* (2006.01)

(52) U.S. Cl. ..... 166/68; 166/105; 166/192

(58) Field of Classification Search ..... 166/68, 166/68.5, 105, 109, 135, 192; 417/56; 92/255
See application file for complete search history.

(56) References Cited

U.S. PATENT DOCUMENTS

| | | | | |
|---|---|---|---|---|
| 2,661,024 | A | 12/1953 | Knox | 137/692 |
| 2,714,855 | A | 8/1955 | Brown | 103/52 |
| 3,029,872 | A * | 4/1962 | Hanes | 166/135 |
| 3,181,470 | A | 5/1965 | Clingnan | 103/52 |
| 4,502,843 | A | 3/1985 | Martin | 417/56 |
| 5,333,684 | A | 8/1994 | Walter et al. | 166/54 |
| 5,868,554 | A | 2/1999 | Giacomino et al. | |
| 6,148,923 | A | 11/2000 | Casey | 166/372 |
| 6,209,637 | B1 | 4/2001 | Wells | |
| 6,241,028 | B1 | 6/2001 | Bijleveld et al. | 175/40 |
| 6,273,690 | B1 | 8/2001 | Fischer, Jr. et al. | 417/555.2 |
| 6,467,541 | B1 | 10/2002 | Wells | |
| 6,591,737 | B2 | 7/2003 | Giacomino | |
| 6,669,449 | B2 | 12/2003 | Giacomino | |
| 6,705,404 | B2 | 3/2004 | Bosley | 166/372 |
| 6,719,060 | B1 | 4/2004 | Wells | |
| 6,746,213 | B2 | 6/2004 | Giacomino | |
| 6,883,612 | B2 * | 4/2005 | Ferguson et al. | 166/68.5 |
| 6,907,926 | B2 | 6/2005 | Bosley | 166/108 |
| 6,935,427 | B1 * | 8/2005 | Billingsley | 166/105 |

(Continued)

FOREIGN PATENT DOCUMENTS

| | | |
|---|---|---|
| RU | 2225502 | 3/2004 |

OTHER PUBLICATIONS

Jeffrey L. Giacomino, U.S. Appl. No. 11/060,513, "Data Logger Plunger" filed Feb. 17, 2005. ( No copy attached per MPEP 609.049(a)(L1)(C) because Application is stored in Image File Wrapper System.).

(Continued)

*Primary Examiner*—Richard E. Chilcot, Jr.
*Assistant Examiner*—Matthew J Smith
(74) *Attorney, Agent, or Firm*—Aileen Law; A Law Firm, P.C.

(57) ABSTRACT

An improved plunger mechanism apparatus to increase well flow production levels. Efficiency of well flow is increased by a two-piece plunger assembly apparatus that is mechanically latched during lift, separates at the well top, and allows a bottom assembly to efficiently fall to the well bottom. The top plunger piece is held at the well top for a set time or condition and when released, its open internal orifice allows it to fall to the well bottom in an efficient manner, and when at the well bottom it mechanically latches, either via a magnetic or mechanical connection, to the bottom assembly.

28 Claims, 11 Drawing Sheets

U.S. PATENT DOCUMENTS

| | | | | |
|---|---|---|---|---|
| 6,945,762 | B2 | 9/2005 | Williams | 417/546 |
| 2003/0141051 | A1 | 7/2003 | Abbott et al. | 166/53 |
| 2003/0155129 | A1 | 8/2003 | Gray et al. | 166/370 |
| 2003/0215337 | A1 | 11/2003 | Lee | 417/56 |
| 2004/0129428 | A1 | 7/2004 | Kelley | 166/372 |

OTHER PUBLICATIONS

MGM Well Services, Inc., company information, acquired from the internet on Feb. 12, 2003 at http://mgmwellservice.com, 2 pages.

MGM Well Services, Inc., "Pacemaker Plunger Co.", acquired from the internet on Feb. 12, 2003 at http://mgmwellservice.com/PacemakerPlunger/Design.htm,2 pages.

* cited by examiner

SECTION A-A

MULTI-PART PLUNGER

CROSS REFERENCE APPLICATIONS

This application is a non-provisional application claiming the benefits of provisional application No. 60/456,667 filed Mar. 18, 2003.

FIELD OF THE INVENTION

The present invention relates to an improved plunger lift apparatus for the lifting of formation liquids in a hydrocarbon well. More specifically the improved plunger consists of a two piece apparatus that operates to increase the well efficiency, insure positive mechanical connection during lift, and separate at the top of the well.

BACKGROUND OF THE INVENTION

A plunger lift is an apparatus that is used to increase the productivity of oil and gas wells. In the early stages of a well's life, liquid loading is usually not a problem. When rates are high, the well liquids are carried out of the tubing by the high velocity gas. As a well declines, a critical velocity is reached below which the heavier liquids do not make it to the surface and start to fall back to the bottom exerting back pressure on the formation, thus loading up the well. A plunger system is a method of unloading gas in high ratio oil wells without interrupting production. In operation, the plunger travels to the bottom of the well where the loading fluid is picked up by the plunger and is brought to the surface removing all liquids in the tubing. The plunger also keeps the tubing free of paraffin, salt or scale build-up. A plunger lift system works by cycling a well open and closed. During the open time a plunger interfaces between a liquid slug and gas. The gas below the plunger will push the plunger and liquid to the surface. This removal of the liquid from the tubing bore allows an additional volume of gas to flow from a producing well. A plunger lift requires sufficient gas presence within the well to be functional in driving the system. Oil wells making no gas are thus not plunger lift candidates.

As the flow rate and pressures decline in a well, lifting efficiency declines geometrically. Before long the well begins to "load up". This is a condition whereby the gas being produced by the formation can no longer carry the liquid being produced to the surface. There are two reasons this occurs. First, as liquid comes in contact with the wall of the production string of tubing, friction occurs. The velocity of the liquid is slowed and some of the liquid adheres to the tubing wall, creating a film of liquid on the tubing wall. This liquid does not reach the surface. Secondly, as the flow velocity continues to slow the gas phase can no longer support liquid in either slug form or droplet form. This liquid, along with the liquid film on the sides of the tubing, begins to fall back to the bottom of the well. In a very aggravated situation there will be liquid in the bottom of the well with only a small amount of gas being produced at the surface. The produced gas must bubble through the liquid at the bottom of the well and then flow to the surface. Because of the low velocity very little liquid, if any, is carried to the surface by the gas. Thus, as explained previously, a plunger lift will act to remove the accumulated liquid.

A typical installation plunger lift system 100 can be seen in FIG. 1. Lubricator assembly 10 is one of the most important components of plunger system 100. Lubricator assembly 10 includes cap 1, integral top bumper spring 2, striking pad 3, and extracting rod 4. Extracting rod 4 may or may not be employed depending on the plunger type. Below lubricator 10 is plunger auto catching device 5 and plunger sensing device 6. Sensing device 6 sends a signal to surface controller 15 upon united plunger mechanism (UPM) 200 at the well top. UPM 200 is shown to represent the plunger of the present invention and will be described below in more detail. Sensing the plunger is used as a programming input to achieve the desired well production, flow times and wellhead operating pressures. Master valve 7 should be sized correctly for the tubing 9 and UPM 200. An incorrectly sized master valve will not allow UPM 200 to pass. Master valve 7 should incorporate a full bore opening equal to the tubing 9 size. An oversized valve will allow gas to bypass the plunger causing it to stall in the valve. If the plunger is to be used in a well with relatively high formation pressures, care must be taken to balance tubing 9 size with the casing 8 size. The bottom of a well is typically equipped with a seating nipple/tubing stop 12. Spring standing valve/bottom hole bumper assembly 11 is located near the tubing bottom. The bumper spring is located above the standing valve and can be manufactured as an integral part of the standing valve or as a separate component of the plunger system.

Surface control equipment usually consists of motor valve(s) 14, sensors 6, pressure recorders 16, etc., and an electronic controller 15 which opens and closes the well at the surface. Well flow 'F' proceeds downstream when surface controller 15 opens well head flow valves. Controllers operate on time, or pressure, to open or close the surface valves based on operator-determined requirements for production. Modern electronic controllers incorporate features that are user friendly, easy to program, addressing the shortcomings of mechanical controllers and early electronic controllers. Additional features include: battery life extension through solar panel recharging, computer memory program retention in the event of battery failure and built-in lightning protection. For complex operating conditions, controllers can be purchased that have multiple valve capability to fully automate the production process.

Modern plungers are designed with various sidewall geometries and can be generally described as follows:

A. Shifting ring plungers for continuous contact against the tubing to produce an effective seal with wiping action to ensure that all scale, salt or paraffin is removed from the tubing wall. Some designs have by-pass valves to permit fluid to flow through during the return trip to the bumper spring with the by-pass shutting when the plunger reaches the bottom. The by-pass feature optimizes plunger travel time in high liquid wells.

B. Pad plungers with spring-loaded interlocking pads in one or more sections. The pads expand and contract to compensate for any irregularities in the tubing thus creating a tight friction seal. Pad plungers can also have a by-pass valve as described above.

C. Brush plungers incorporate a spiral-wound, flexible nylon brush section to create a seal and allow the plunger to travel despite the presence of sand, coal fines, tubing irregularities, etc. By-pass valves may also be incorporated.

D. Solid plungers with solid sidewall rings for durability. Solid sidewall rings can be made of various materials such as steel, poly materials, Teflon, stainless steel, etc. Once again, by-pass valves can be incorporated.

E. Snake plungers, which are flexible for coiled tubing and directional holes, and can be used as well in straight standard tubing.

Recent practices toward slim-hole wells that utilize coiled tubing lend also themselves to plunger systems. Because of the small tubing diameters, a relatively small amount of liquid may cause a well to load-up or a relatively small amount of paraffin may plug the tubing.

Plungers use the volume of gas stored in the casing and the formation during the shut-in time to push the liquid load and plunger to surface when the motor valve opens the well to the sales line or to the atmosphere. To operate a plunger installation, only the pressure and gas volume in the tubing/casing annulus is usually considered as the source of energy for bringing the liquid load and plunger to surface.

The major forces acting on the cross-sectional area of the bottom of the plunger are:

- The pressure of the gas in the casing pushes up on the liquid load and the plunger;
- The sales line operating pressure and atmospheric pressure push down on the plunger;
- The weight of the liquid and the plunger pushes down on the plunger;
- Once the plunger begins moving to the surface, friction between the tubing and the liquid load acts to oppose the plunger;
- In addition, friction between the gas and tubing acts to slow the expansion of the gas.

The major disadvantage of conventional plunger lifts is that the well must be shut-in in order for the plunger to fall to the bottom of the well. Two part plunger systems (ball-type or other non-positive mechanical plungers) can lose plunger piece to piece contact during lift due a drop in critical velocity, collar banging, hitting slugs of fluid, paraffin or scale particles, which decreases well efficiency. If the ball falls back to the bottom, fluid is then allowed to fall back to the bottom, which keeps the well in a loaded state. The only thing that holds the ball on the plunger is the upward flow of gas and fluid. See U.S. Pat. Nos. 6,209,637 and 6,467,544 to Wells. When the Wells two-part piston rises, changing well conditions can cause the ball to disconnect from the sleeve, resulting in lost well production.

The present invention in its various embodiments latches a lower plug to an upper sleeve, thereby preventing an accidental separation. Plunger drop travel time slows or limits well production. Also fishing balls out of a well is a problem and sometimes requires pulling the complete tubing string. Well production increases are always critical. What is needed is a plunger lift apparatus that can insure a positive contact during lift, drop back to the well bottom quickly and easily and assist in increasing well production by increasing lift cycle times. What is also needed is a two-part plunger system that is retrievable from the well. The apparatus of the present invention provides a solution to these aforementioned deficiencies.

SUMMARY OF THE INVENTION

The main aspect of the present invention is to provide a two part plunger apparatus that will increase well production levels.

Another aspect of the present invention is to provide a two part plunger apparatus that ensures a mechanical connection during the lift from the well bottom and that will mechanically separate at the lift top.

Another aspect of the present invention is to allow both the plunger top mechanism (PTM) and the plunger bottom mechanism (PBM) to independently fall inside the tubing to the well hole bottom with increased speed without impeding well production.

Another aspect of the present invention is to allow for current plunger sidewall geometries to be utilized in the PTM.

Yet another aspect of the present invention is to provide for a magnetic latching of the PTM and PBM during lift, the preferred embodiment.

Another aspect of the present invention is to provide for a mechanical latching of the PTM and PBM during lift, an alternate embodiment.

Yet another aspect of the present design is to provide a design that has an inherent flow by-pass when falling, thus eliminating any need for a by-pass valve.

Other aspects of this invention will appear from the following description and appended claims, reference being made to the accompanying drawings forming a part of this specification wherein like reference characters designate corresponding parts in the several views.

The present invention comprises a plunger lift consisting of two separate parts that will latch together at the well bottom thus creating a united plunger mechanism (UPM) acting to carry fluids from the bottom of the well to the surface. The latching is a magnetic latching in the preferred embodiment. The latching can also be a mechanical latching in alternate embodiments. The UPM latching is deactivated at the top of the well by a rod or other de-latching device, thereby separating the UPM into the PTM and PBM. The PTM is auto-caught and held in the lubricator at the top surface while the PBM is allowed to separately fall back into the well.

The PTM will be dropped back into the well when well conditions are met with liquid loading. The PTM will re-latch to the PBM when it returns to the well bottom to form a solid two-piece plunger, the UPM.

The preferred embodiment of the present invention employs a fairly strong permanent magnet, which is encased within the PBM to provide a magnetic attachment to the PTM. Other embodiments of the present invention employ a mechanical latch between the PTM and PBM during lift.

The PBM is designed to have a smaller outside diameter (OD) than the tubing and a geometric design to allow it to quickly travel to the well bottom without impeding well flow. The PTM is designed with standard aforementioned sidewall geometries and a hollow inside to allow it to quickly travel to the well bottom once it is released by the auto-catcher at the surface.

The present invention assures an efficient lift due to the fact that both the PTM and PBM are latched to form one plunger unit during lift. The present invention also optimizes well efficiency due to the fact that both PTM and PBM can separately and quickly travel to the well bottom.

Figure 1:
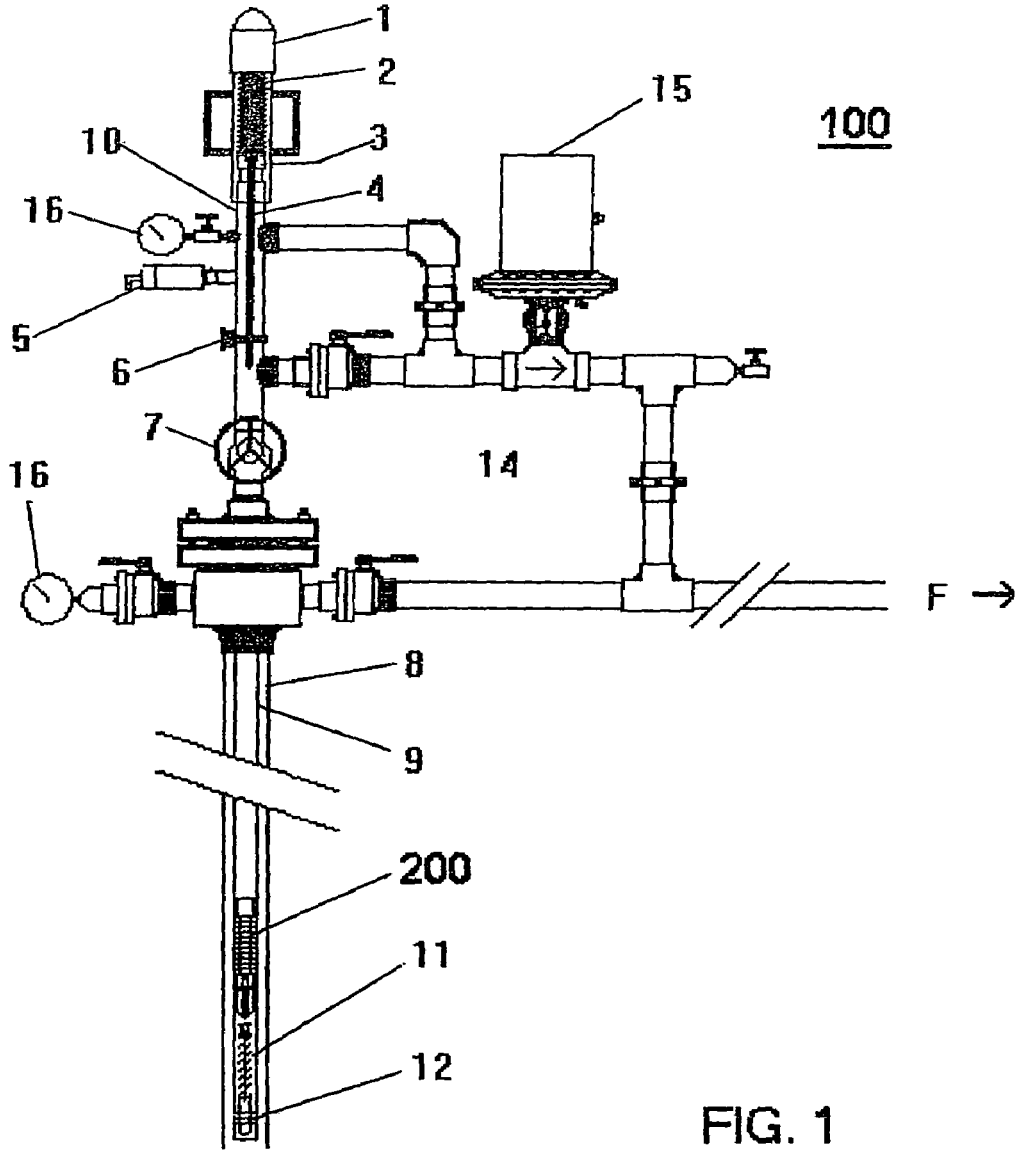
FIG. 1 (prior art) is an overview depiction of a typical plunger lift system installation.

Before explaining the disclosed embodiments of the present invention in detail, it is to be understood that the invention is not limited in its application to the details of the particular arrangements shown, since the invention is capable of other embodiments. Also, the terminology used herein is for the purpose of description and not of limitation.

DETAILED DESCRIPTION OF THE DRAWINGS

The present invention provides a plunger lift apparatus that consists of two basic parts, a PTM and a PBM that are latched together to form the UPM during lift. The plunger lift of the present invention basically consists of the following discrete steps:

1. The two piece plunger, or UPM, is at the bottom of a well in a mechanically latched state (magnetic or mechanical) with liquid loading on top of the plunger;
2. The well is open for flow at which time the UPM rises to carry liquids out of the well bore.
3. The UPM separates at the top of the well into its basic components, the PTM and PBM, via a de-latching rod (or other means) while the PTM is secured in an auto-catcher and the PBM starts down the well at an increased speed against the well flow without effecting well operating efficiency due to its cross-sectional geometry, which will be described below in more detail.
4. The well flows for a set time or condition controlled by the well-head controller.
5. The auto-catcher releases the PTM after a set time or condition.
6. The PTM, with its hollowed center orifice, falls against the well flow at a faster rate than a standard plunger and latches to the PBM at the well bottom. The orifice allows the PTM to travel to the well bottom without impeding well flow and also optimizes plunger travel time in high liquid wells.
7. The well plunger lift cycle starts again.

The PTM and PBM that are latched together to form a single UPM during lift and separate back into two discrete parts (PTM and PBM) once at the well surface. The UPM acts as a sealed device during lift that functions to carry fluids to the well surface. The latching of the PTM and PBM during lift is maintained via either magnetic or mechanical latching. The preferred embodiment of the present invention employs a magnetic latching design. It should be noted that mechanical latching could also be employed.

The utilization of magnetic (or mechanical) latching assures connection of the PTM and PBM during the UPM lift from the well bottom. The mechanical separation of the UPM into the PBM and PTM is accomplished by a rod or de-latch-ing device at the top of the well, usually contained within the lubricator. Older systems employing a ball and top plunger mechanism tend to separate during lift causing lift restarts.

The PBM is geometrically designed to have a fluid/gas dynamic type shape to allow it to quickly pass against the flow and to the well bottom. Such designs may include, but not be limited to, a torpedo shape, an anvil shape, etc. The PBM is designed with outside dimensions to be sufficiently smaller than the tubing inside diameter allowing it to efficiently fall against the flow of the well. The PBM design allows gas or liquids to continue to flow to the well surface after the lift is complete and the PBM is falling against the well flow. The PBM will return to the bottom with an efficient speed until it comes to rest on the bottom sitting or on a bumper spring. This aforementioned falling action of the PBM will allow the well to continue to flow and will not impact the well flow efficiency thereby allowing for higher well production levels. If the 'difference' in cross-sectional area of the PBM and the inside cross-sectional area of well tubing is equal to or greater than the minimum cross-sectional area of any other flow point in the well, full well flow can continue without the PBM impeding maximum flow. Likewise, no well flow will be impeded by the PTM if the inner orifice cross-sectional area of the PTM is greater than or equal to the minimum cross-sectional area of any other flow point in the well. The time to fall of both the PBM and the PTM is shorter than prior art allowing a time-savings in lift cycles, thus adding to well efficiency. Older design, solid plungers, not only required well shut-off, but also could not be released to fall back to the well bottom until flow had stopped.

In the preferred embodiment of the present invention, the PBM contains a relatively strong internal magnet. The magnet is positioned in proximity below the top surface of the PBM with its North and South poles facing in an axial direction along the PBM. A non-magnetic material is placed around the peripheral surface of the magnet (between the magnet and the outside surface of the PBM) to optimize magnetic flux lines to flow between the magnet's north and south poles. The top surface of the PBM is designed with a magnetic material and is annular in shape with a slanted surface (cone type shaped) to optimize magnetic latching to similar but outside annular type surface on the PTM. It should be noted that other surface shapes could be employed. Although the PBM of the preferred embodiment might consist of separate parts; combinations of set pins, screw-type designs or other mechanisms can be used to secure all individual parts into a one-piece PBM to hold each of its components together.

When the UPM is lifted to the top of the well and separation occurs allowing the PBM to fall to the bottom, the PTM is caught and held at the top of the well by an auto catcher. The PTM is dropped back into the well when pre-determined well conditions are met. The PTM will re-latch to the PBM when it returns to the well bottom to form a united two-piece plunger, the UPM. The PTM is designed with an inside hollow orifice which allows it to quickly fall back into the well, against the well flow, without impacting well production. The outside surface of the PTM can be designed with any of the aforementioned type geometries such as ring, pad, brush, solid or snake. The inside hollow orifice design permits an inherent flow by-pass when falling, thus eliminating any need for a separate by-pass valve. Elimination of by-pass valves as found in prior art plungers increases plunger reliability and also avoids extra maintenance associated with cleaning obstructed valve and/or passages. The bottom of the PTM is made of a ferromagnetic material to help produce the most strongly magnetic attraction in latching to the PBM. The shape of the bottom of the PTM is annular and with an inside conical opening at the orifice to accept the shape of the outside conical dimension of the PBM. When the PTM falls to the well bottom, it magnetically latches to the PBM. This magnetic latching assures continuous latching during lift. The shape of the top of the PTM can be designed such that it allows easy retrieval from the well bottom. An indented inside top collar would easily allow a ball and spring mechanism on a plunger retriever to fall inside the PTM orifice (under spring pressure) at its top position. The top collar of the PTM can be designed with a standard American Petroleum Institute (API) internal fishing neck. The spring loaded ball within the retriever and protruding outside its surface would thus fall within the API internal fishing neck at the top of the PTM orifice for a small distance to a point wherein the inside diameter of the PTN orifice would increase to allow the ball to spring outward. This condition would allow retrieving of the entire UPM as the UPM is in its latched state.

Alternate embodiments of the present invention can utilize a mechanical latching of the PTM and PBM during lift. Such embodiments might employ mechanical means such as ball and spring mechanisms on one device (PTM or PBM) to latch into a groove on the other device (PBM or PTM).

The present invention assures an efficient lift due to the fact that both the PTM and PBM are latched to form one plunger unit during lift. The present invention also optimizes well efficiency due to the fact that both PTM and PBM can separately and quickly travel to the well bottom. Preliminary data indicates productivity increases ranging from 120% to 200% depending on well parameters.

Figure 2:
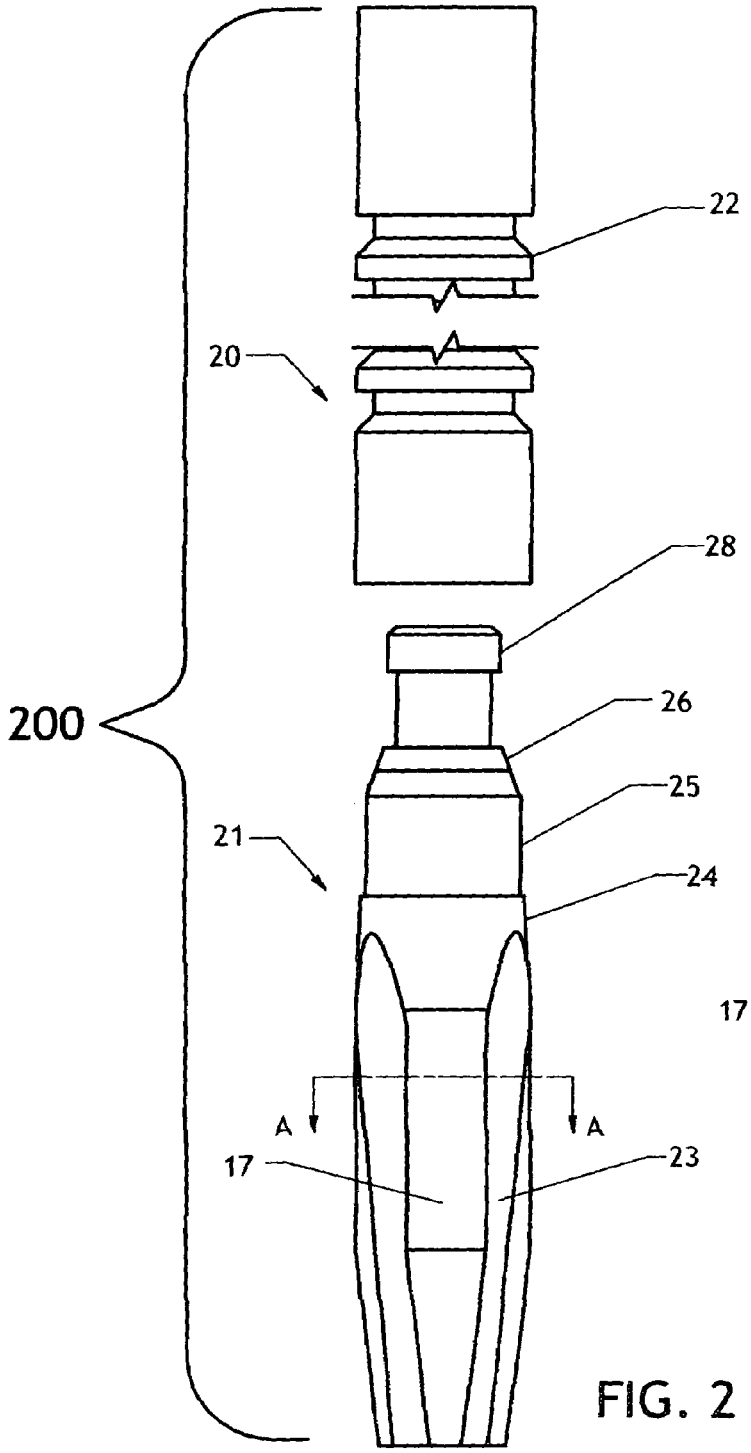
FIG. 2 is a side view of the preferred embodiment of a UPM, separated into its PTM and PBM units.

Referring now to the drawings, FIG. 2 is a side view of the preferred embodiment of UPM 200 separated into both the PTM 20 and PBM 21. PTM 20 is shown with a 'solid ring' 22 sidewall geometry. As previously described, other sidewall geometries such as 'brush', 'ring', 'pad' etc. can be employed in PTM 20. PTM 20 is basically an annular apparatus with an inner orifice, which can be seen below in FIGS. 3, 4A. PBM 21 is shown with an anvil-type shape to optimize efficiency when dropping against the well flow, while allowing the well flow to continue. PBM 21 consists of the following components:

1. Liquid/gas by-pass bottom end 24 with a mandrel type section with main flute 23 in a triangular shape and outer flutes 17 as inverted triangular shaped areas (see FIG. 2A);
2. By-pass south connector 25;
3. Magnet isolator ring 26, which is made of non-magnetic (anti-ferromagnetic) material, and contains the magnet (not shown). Magnet isolator ring 26 can be seen externally as an annular ring around the area surrounding the internal PBM magnet; and
4. By-pass head 28.

Figure 2A:
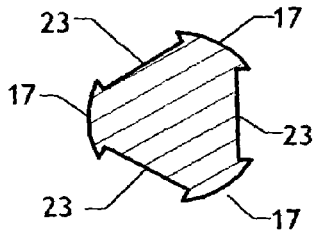
FIG. 2A is a cross-sectional view of the PBM unit at point A-A of FIG. 2.

FIG. 2A is a cross-sectional view of the PBM 21 unit across point A-A of FIG. 2. The A-A cross-sectional area of liquid/gas by-pass end 21 is shown as a mandrel type section with main flute 23 in a triangular shape and outer flutes 17 as inverted triangular shaped areas. It should be noted that although a specific geometry is shown, other geometries can be easily designed (for example, anvil shaped, spear shaped or other) that would allow PBM 21 to easily fall against the well flow. A good design for PBM 21 can be obtained if the cross-sectional area for 'any' cross section cut across PBM 21 has an area such that the 'difference' between the cross-sectional area of PBM 21 and the cross-sectional area of the inner diameter of tubing 8 (ref. FIG. 1) is greater than the 'minimum' cross-sectional area of any other flow point in the well. This will assure that PBM 21 does not impede the well flow. Likewise, the cross-sectional area of PTM orifice should be equal to or greater than the 'minimum' cross-sectional area of any other flow point in the well.

Figure 3:
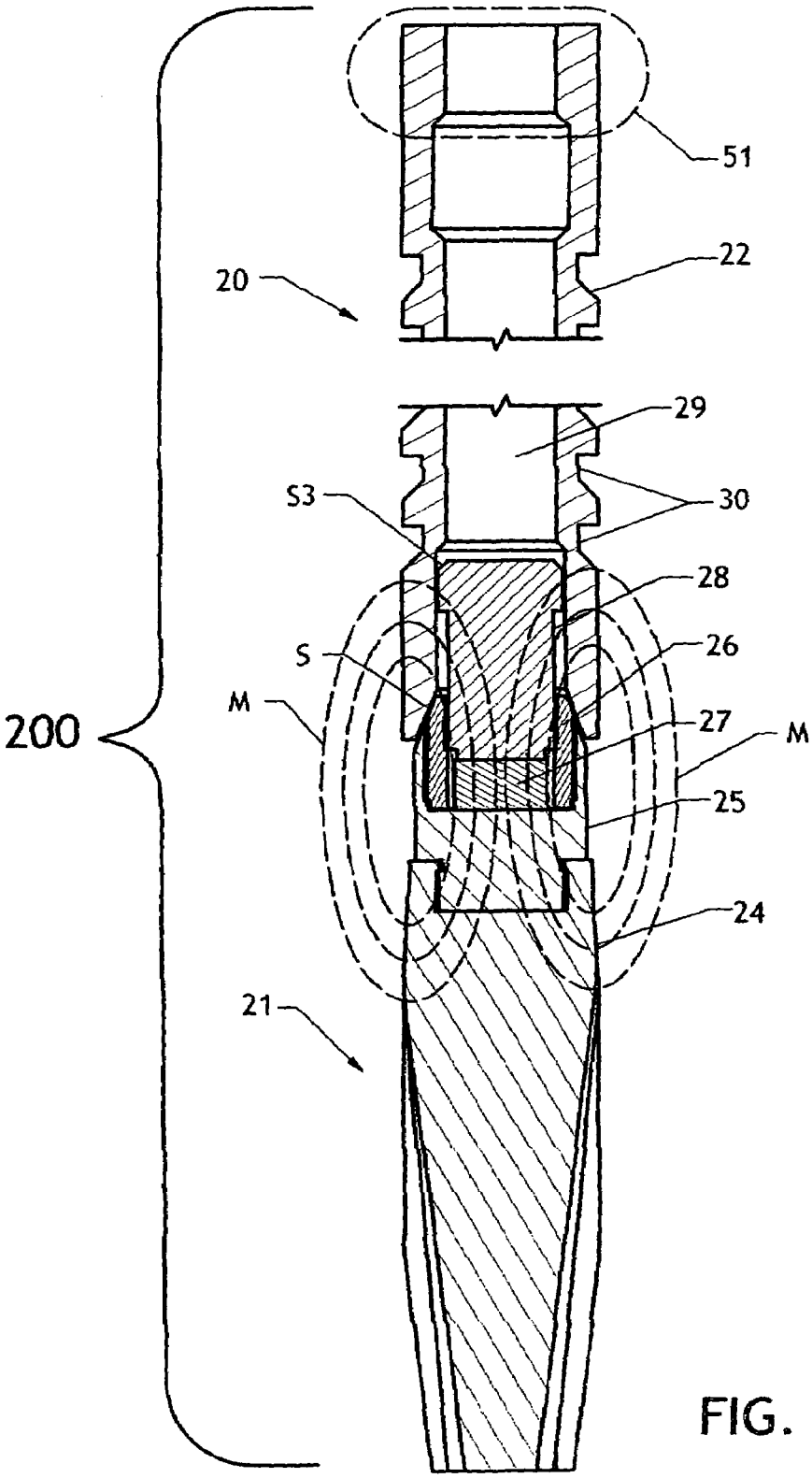
FIG. 3 is a side cross sectional view of the preferred embodiment of the present invention showing the UPM, shown in its magnetically latched state.
Figure 6:
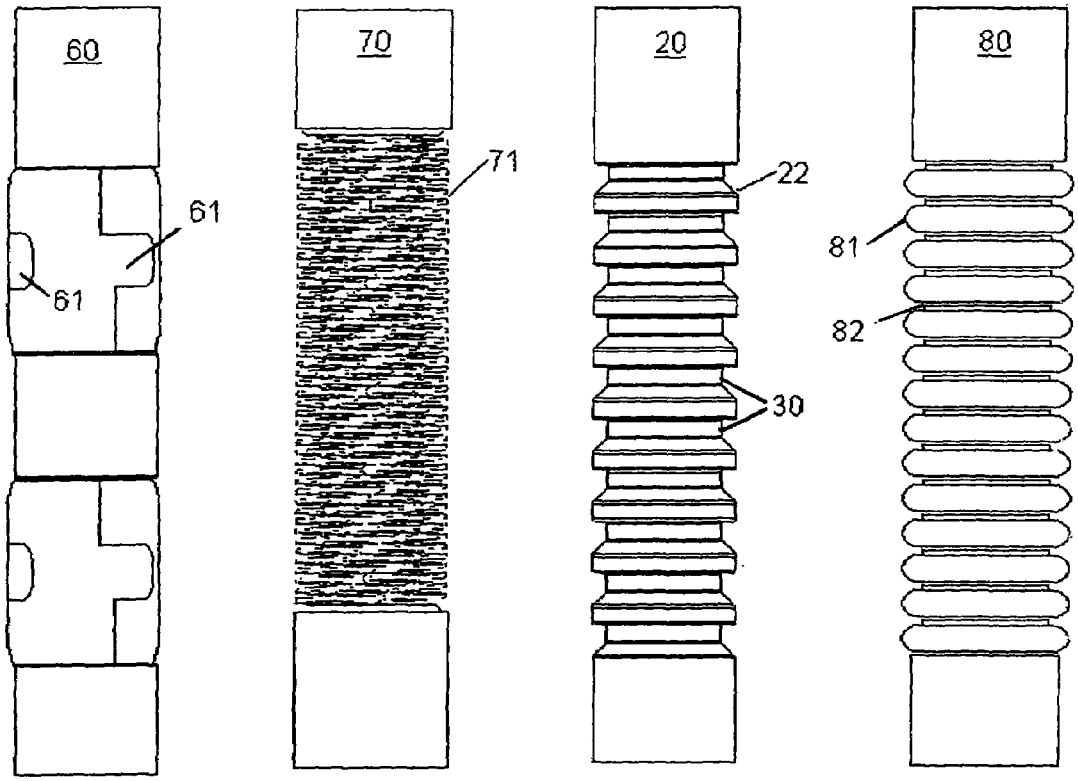
FIG. 6 is a side view of various prior art side-wall geometries.

FIG. 3 is a side cross sectional view of the preferred embodiment of a UPM 200, shown in its magnetically latched state with PTM 20 magnetically latched to PBM 21. PBM 21 is magnetically drawn into the bottom orifice of PTM 20 when fully magnetically latched. PBM 21 is shown in the preferred embodiment consisting of a plurality of sub-assembly components. Liquid/gas flow by-pass end 24 is designed in mandrel-type geometry to assist PTM 20 to easily fall against the well flow. Other geometries (i.e., anvil, spear, torpedo etc.) could also be employed. Other PBM 21 subassembly parts consist of subassembly bypass south connector 25, magnet isolator ring 26 (anti-ferromagnetic material), magnet 27, and by-pass head 28. Surface S is the conical surface at which annular surfaces from PTM 20 and PBM 21 are held magnetically and acts as a seal during lift. Annular upper surface S3 provides a secondary seal. Magnet 27 is of sufficient strength to pull PBM 21 up into the receiving PTM orifice 29. Magnetic flux lines M are shown which permeate both sections of PTM 20 and PBM 21. PTM 20 is shown with a solid ring 22 outer surface geometry. Inner cut grooves 30 of this geometry allow sidewall debris to accumulate when PTM is rising or falling. Other outer surfaces can also be employed (ref. FIG. 6). The top 51 of PTM 20 (see also FIG. 4A) is designed as an API internal fishing neck for easy retrieval by a standard API internal fishing neck retrieving pickup mechanism (not shown) to retrieve UPM 200 in its mechanically latched form.

Figure 4A:
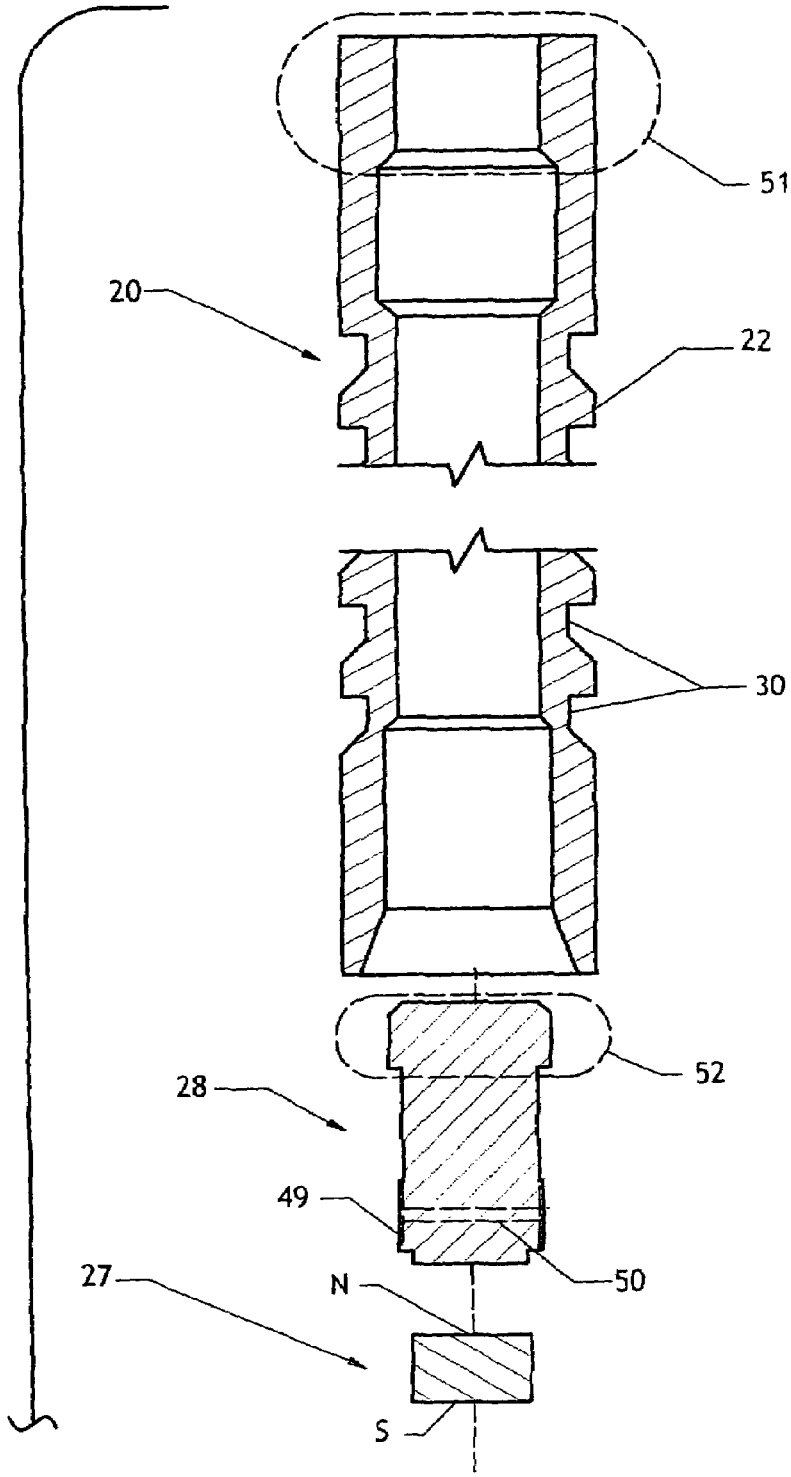
FIGS. 4A, 4B are blow-up cross-sectional views of the preferred embodiment of the present invention showing each subassembly of the UPM.
Figure 4B:
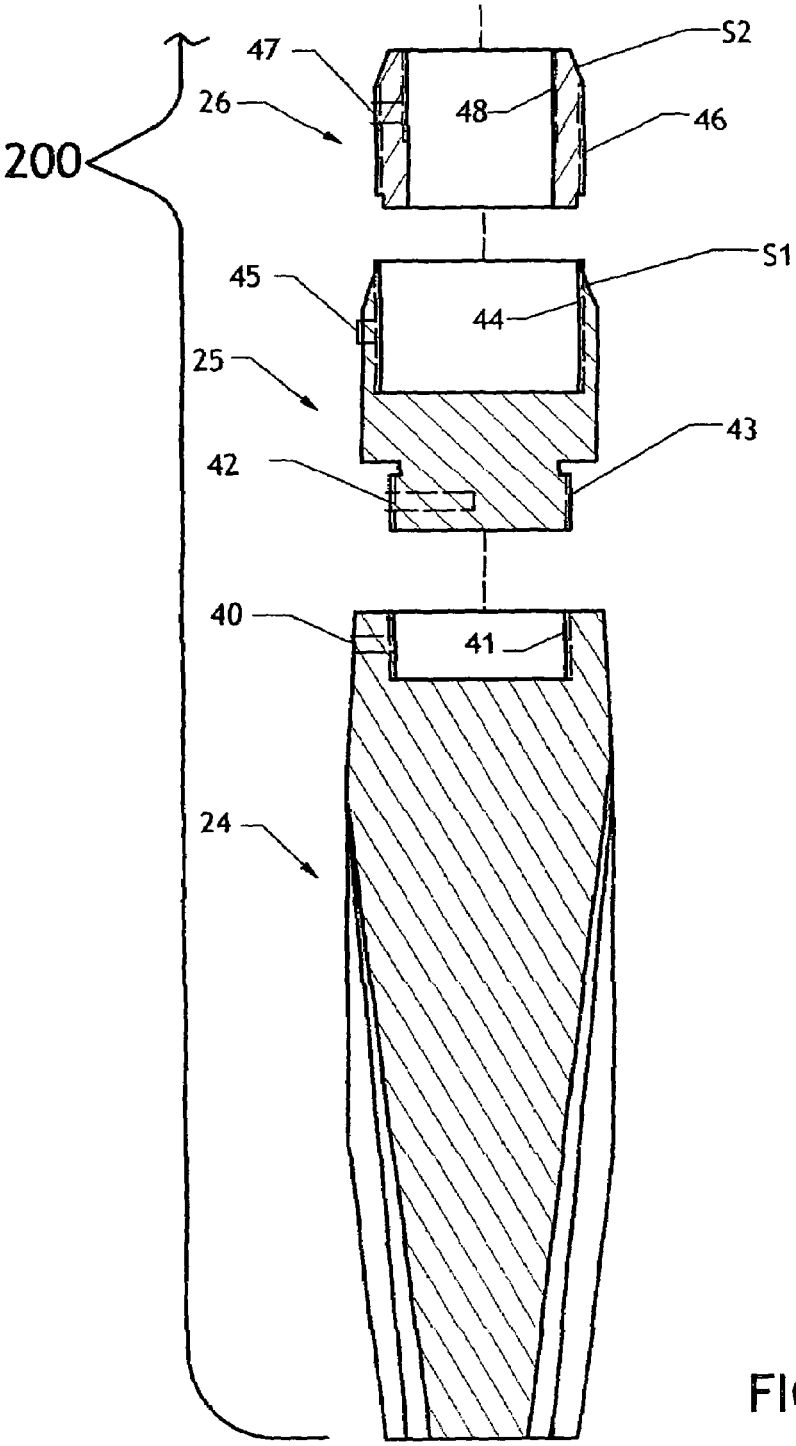

FIGS. 4A, 4B are blow up views of UPM 200 showing each subassembly of PBM 21. PTM 20 is shown with a solid ring 22 outer surface geometry and containing inner grooves 30. Liquid/gas by-pass end 24 is fluid/gas dynamic in shape allowing it to cut through the well flow. Shapes other than that shown can also be employed. Bottom end threaded area 41 allows for mechanical threading connection to bypass south connector 25 lower threads 43. Liquid/gas by-pass roll pin hole 40 and bypass south connector roll pin hole 42 are aligned for a pressed pin (not shown) positive retention mechanism between liquid/gas by-pass end 24 and bypass south connector 25. A magnet insulator ring 26 is attached to bypass south connector 25 via screwing south connector threads 44 and magnet insulator ring threads 46. The magnet insulator ring 26, which is a non-magnetic element such as aluminum, serves to isolate the sides of the magnet, thereby radiating longitudinally the magnetic flux lines M (see FIG. 3) to better couple magnet 27 to PTM 20. Bypass south connector roll pin hole 45 and magnet insulator ring roll pin hole 47 are aligned for a pressed roll pin (not shown) positive retention to hold both sub-assemblies into position. Magnet 27 is permanently positioned and is shown such that its north pole N faces upward and its south pole S faces downward. It should be noted that magnet 27 could also be aligned in an opposite manner to that shown, that is, with its north pole N facing downward and its south pole S facing upward. Surface S1 is aligned and extends to surface S2 when both subassemblies are together. These form annular surface S (ref. FIG. 3) of PBM 21 at which point PTM 20 and PBM 21 are held together magnetically. Top 52 of by-pass head 28 is insertable into a hollow bottom portion of PTM 20. By-pass head 28 mates to magnet insulator ring 26 via by-pass head threads 49 and magnet insulator threads 48. Both units are mechanically held together by a roll pin (not shown) placed by aligning magnet insulator roll pin hole 47 with by-pass head roll pin hole 50. Roll pins are inserted after alignment and retained via compression or spreading of roll pin end(s). It should be noted that alignment of all roll pin holes in PBM 21 could be accomplished by any of the following methods:

1. Threading all PBM parts together and then drilling a roll pin holes in appropriate locations.
2. Pre-drilling roll pin holes and aligning holes after PBM parts are threaded together.

It should also be noted that other means of connecting PBM parts can be accomplished via use of adhesives within the threads to hold parts together (i.e. no roll pins) or other fastening means.

Figure 5:
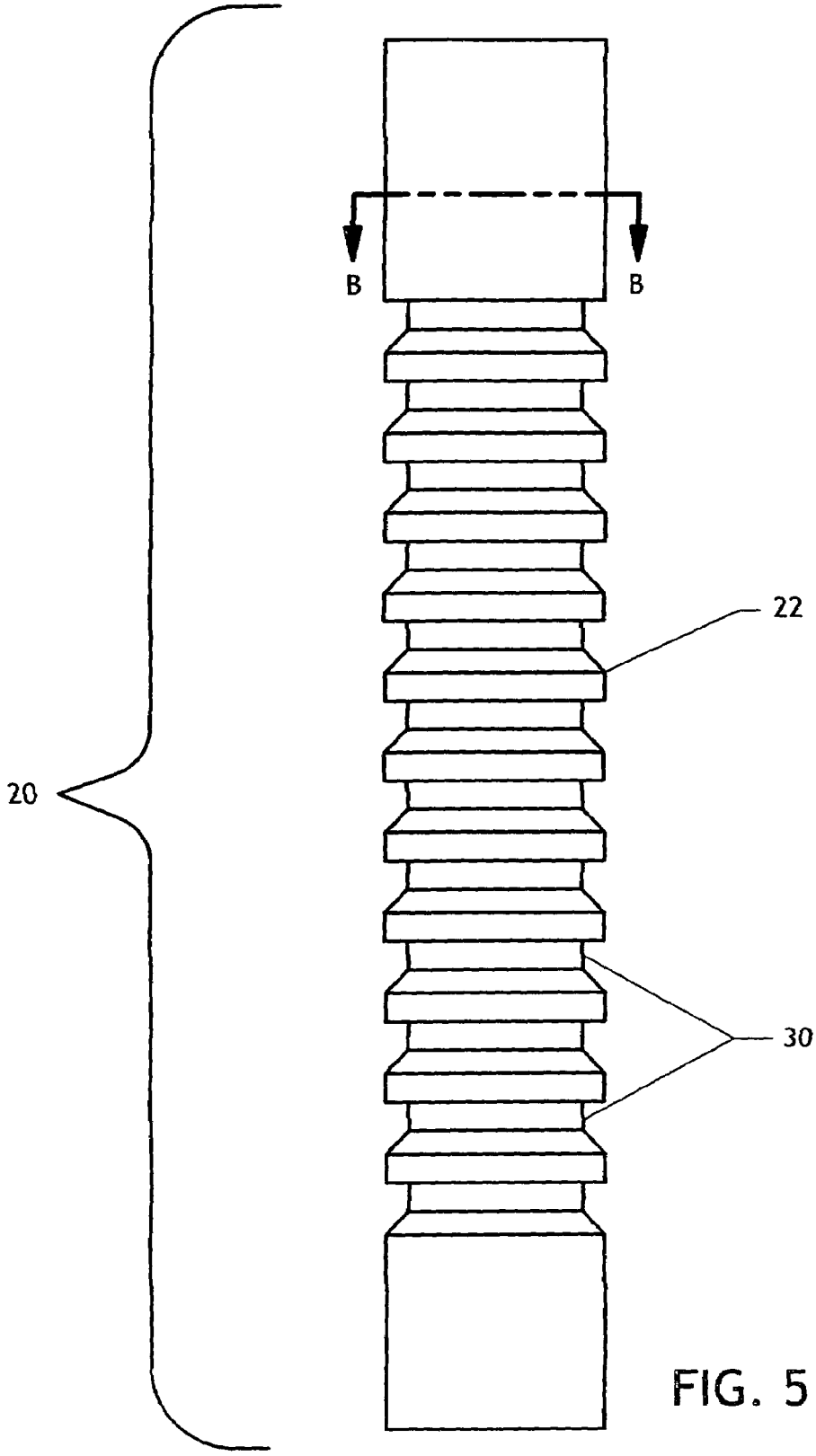
FIG. 5 is a side view of the PTM having solid ring side-wall geometry.

FIG. 5 is a side view of PTM 20 with solid rings 22 sidewall geometry for durability and containing inner grooves 30. Sidewall geometry can be made of various materials such as steel, poly materials, Teflon, stainless steel, etc. Cross-section B-B is described below in FIG. 12.

FIG. 6 is a side view of various side-wall geometries of the PTM. All geometries described below have an internal orifice as previously described in PTM 20. All side-wall geometries described below can be found in present industrial offerings. These side-wall geometries are described as follows:

A. As previously discussed solid ring 22 sidewall is shown in solid plunger PTM 20. Solid sidewall rings 22 can be made of various materials such as steel, poly materials, Teflon, stainless steel, etc.

B. Shifting ring 81 sidewall geometry is shown in shifting ring plunger top mechanism 80. Shifting rings 81 sidewall geometry allows for continuous contact against the tubing to produce an effective seal with wiping action to ensure that all scale, salt or paraffin is removed from the tubing wall. Shifting rings 81 are all individually separated at each upper surface and lower surface by air gap 82.

C. Pad plunger top mechanism 60 has spring-loaded interlocking pads 61 in one or more sections. Interlocking pads 61 expand and contract to compensate for any irregularities in the tubing thus creating a tight friction seal.

D. Brush plunger top mechanism 70 incorporates a spiral-wound, flexible nylon brush 71 surface to create a seal and allow the plunger to travel despite the presence of sand, coal fines, tubing irregularities, etc.

Figures 7, 8, 9, 10:
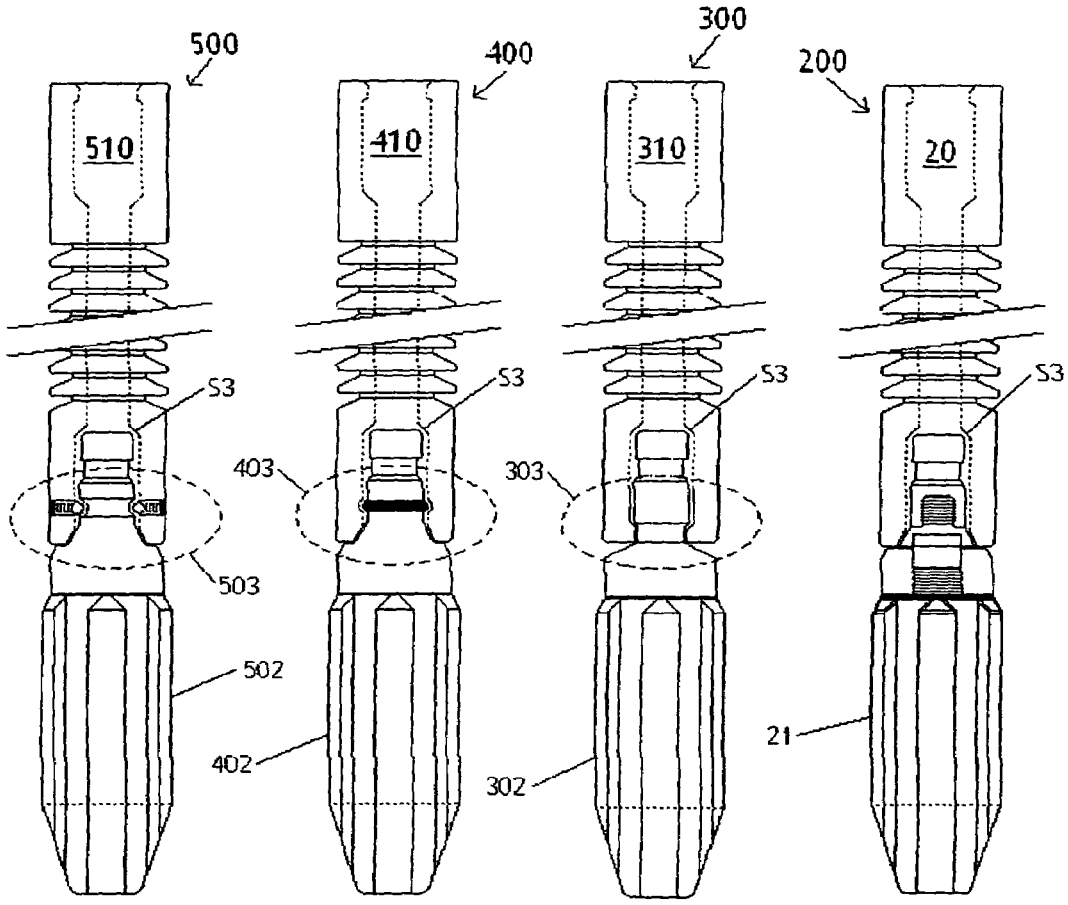
FIG. 7 is a side view of the UPM with magnetic latching, the preferred embodiment of the present invention.
FIG. 8 is a side view of latch-down pickup, an alternate embodiment of the present invention.
FIG. 9 is a side view of a compression ring pickup, yet another alternate embodiment of the present invention.
FIG. 10 is a side view of a spring-loaded pickup, still another alternate embodiment of the present invention.

FIG. 7 is a side view of the UPM 200 with magnetic latching, the preferred embodiment of the present invention. Shown are aforementioned PTM 20 and PBM 21. It is shown again for reference purposes alongside alternate embodiments.

Figure 8A:
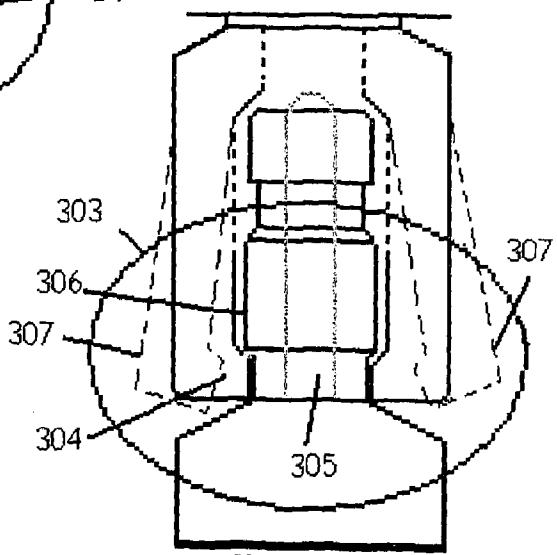
FIG. 8A is a blow up of the latch-down pickup area of a compression ring pickup shown in FIG. 8.

FIG. 8 is a side view of latch-down pickup 300, an alternate embodiment of the present invention. In this alternate embodiment, latch down top mechanism 310 is mechanically latched to latch down bottom mechanism 302. FIG. 8A is a blow up of the latch-down pickup area 303. At the bottom of latch down top mechanism 310 is a set of two or more female pickup fingers 304, which wrap around recessed male sleeve 305. Recessed male sleeve 305 is tapered down from upper neck 306 providing a recess for female pickup fingers 304 to compress around recessed male sleeve 305. Female pickup fingers 304 (two or more) will expand in direction 307 as shown when upper neck 306 enters latch down top mechanism 310 and contract when over tapered down recessed male sleeve 305. Surface mating area S3 provides for a seal upon plunger lift. An orifice in latch down top mechanism 310 is similar to PTM orifice 29 as previously described. As aforementioned extracting rod 4 (ref. FIG. 1) separates latch down top mechanism 310 from latch down bottom mechanism 302 upon lift completion at the well top.

Figure 9A:
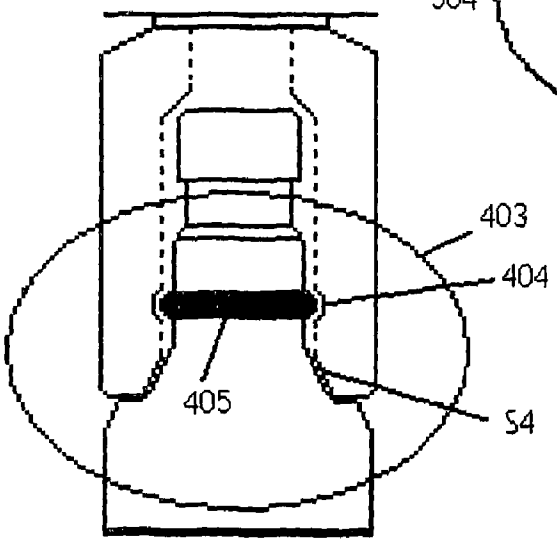
FIG. 9A is a blow up of the compression ring pickup area as shown in FIG. 9.

FIG. 9 is a side view of compression ring pickup 400. In this alternate embodiment, compression ring top mechanism 410 is mechanically latched to compression ring bottom mechanism 402. FIG. 9A is a blow up of compression ring pickup area 403. At the bottom of compression ring top mechanism 410 is recessed groove annular ring 404, which allows compression ring 405 to expand, thereby allowing compression ring top mechanism 410 to mechanically latch to compression ring bottom mechanism 402. Compression ring 405 is affixed to compression ring bottom mechanism 402 and will compress as compression ring bottom mechanism 402 enters compression ring top mechanism 410. Compression ring 405 can be made with various compressible materials such as, but not limited to, rubber, nylon, steel, or other metallic or poly-type materials. Surface mating area S3 provides for a seal upon plunger lift. An orifice in compression ring top mechanism 410 is similar to PTM orifice 29 as previously described. As aforementioned extracting rod 4 (ref. FIG. 1) separates compression ring top mechanism 410 from compression ring bottom mechanism 402 upon lift completion at the well top.

Figure 10A:
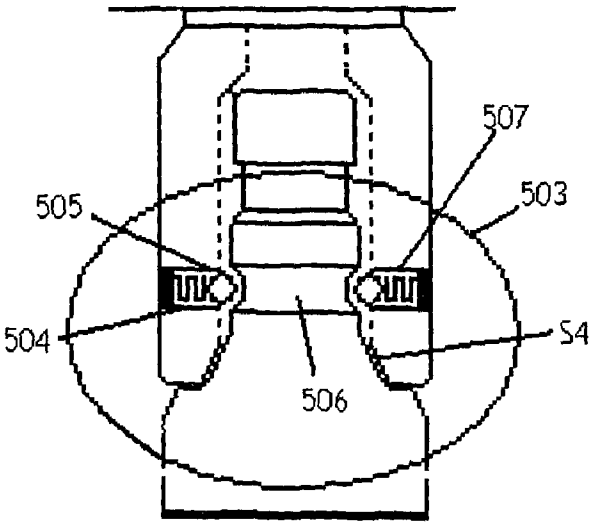
FIG. 10A is a blow up of the spring-loaded pickup area as shown in FIG. 10.

FIG. 10 is a side view of a spring-loaded pickup 500, still another alternate embodiment of the present invention. In this alternate embodiment, spring-loaded top mechanism 510 is mechanically latched to spring-loaded bottom mechanism 502. FIG. 10A is a blow up of the spring-loaded pickup area 503 as shown in FIG. 10. At the bottom of spring-loaded top mechanism 510 is a recessed area containing spring 504 and ball 505, which sit in slot hole 507. Ball 505 will contract into spring 504 when spring-loaded bottom mechanism 502 enters spring-loaded top mechanism 510. Spring-loaded bottom mechanism 502 contains recessed annular groove (bearing race) 506 which will allow ball 505 to expand out from spring 504 and maintain a mechanical connection between units as spring-loaded bottom mechanism 502 enters into spring-loaded top mechanism 501. Surface mating area S3 provides for a seal upon plunger lift. An orifice in spring-loaded top mechanism 501 is similar to PTM orifice 29 as previously described. As aforementioned extracting rod 4 (ref. FIG. 1) separates spring-loaded top mechanism 501 from spring-loaded bottom mechanism 502 upon lift completion at the well top.

It should be noted that other types of mechanical pickup mechanisms could be designed to insure a 'positive' mechanical contact during plunger lift.

Figure 11:
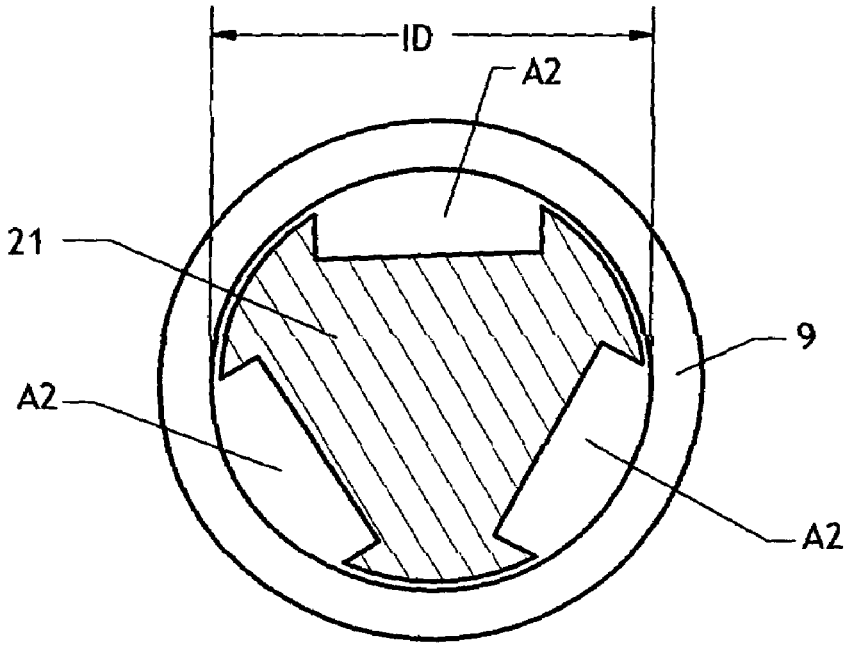
FIG. 11 is a horizontal cross-sectional view of FIG. 2, taken along line A-A, viewed in the direction taken by the arrows.
Figure 12:
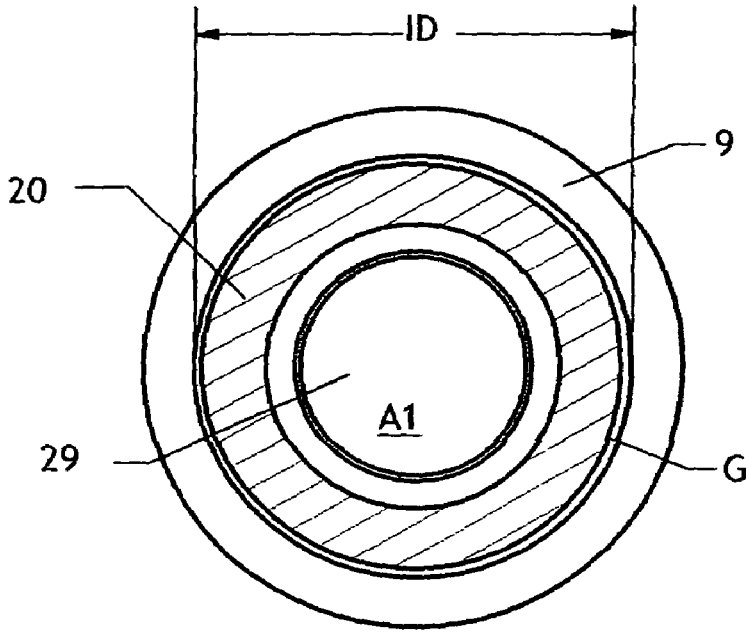
FIG. 12 is a horizontal cross-sectional view of FIG. 5, taken along line B-B, viewed in the direction taken by the arrows.

FIG. 11 is a horizontal cross-sectional view of FIG. 2, taken along line A-A, viewed in the direction taken by the arrows. Shown is PBM 21 inside of inner diameter ID of well tubing 9. If area A2 is equal to or greater than the minimum cross-sectional area of any other flow point in the well, full well flow can continue without the PBM impeding maximum flow. PBM 21 has many different cross-sectional areas, and although only one area is shown, if the 'difference' in any cross-sectional area of the PBM and the inside cross-sectional area of well tubing is equal to or greater than the minimum cross-sectional area of any other flow point in the well, full well flow can continue without the PBM impeding maximum flow FIG. 12 is a horizontal cross-sectional view of FIG. 5, taken along line B-B, viewed in the direction taken by the arrows. PTM 20 is shown inside inner diameter ID of tubing 9. A very small gap G between the outside of PTM 20 and inside diameter ID of tubing 9 allows PTM 20 to travel down tubing 9 to the well bottom where it will attach to PBM 21. In this case the inside cross-sectional area A1 of orifice 29 should be equal to or greater than the 'minimum' cross-sectional area of any other flow point in the well in order to optimize well flow.

Figure 13:
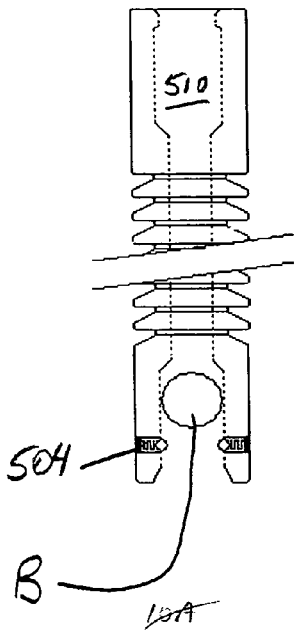
FIG. 13 is a side view of a spring-loaded top sleeve with a partial cutaway having a ball as the sealing plunger.

Referring next to FIG. 13 spring-loaded top mechanism 510 is shown in cutaway view and described in FIG. 10. However, ball B serves as the sealing plunger, also called the bottom mechanism.

Figure 14:
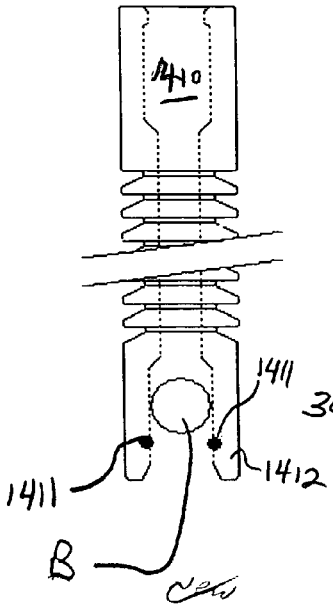
FIG. 14 is a side view of a compression ring top sleeve with a partial cutaway having a ball as the sealing plunger.

Referring next to FIG. 14 compression ring top mechanism 1410 has an O-ring shown in cutaway view, also called a compression ring 1411 in a groove 1411 of the lower arm 1412. This embodiment functions similar to the FIG. 9 embodiment using ball B as the bottom mechanism.

Figure 15:
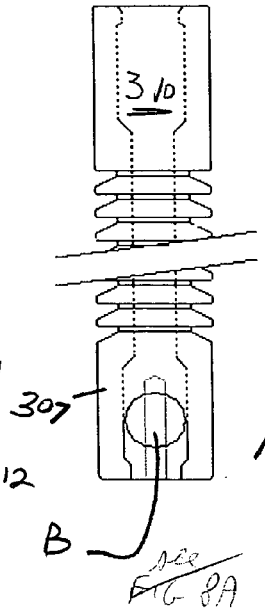
FIG. 15 is a side view of a latch down top sleeve with a partial cutaway having a ball as the sealing plunger.

Referring next to FIG. 15 latch down top mechanism 310 is shown in cutaway view and described in FIG. 8. However, ball B serves as the bottom mechanism.

Figure 16:
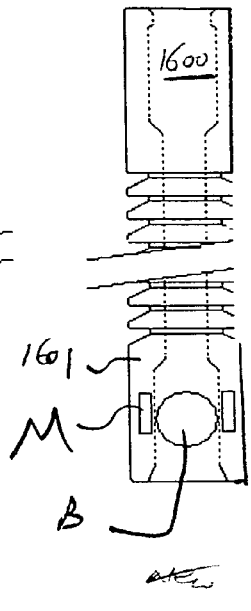
FIG. 16 is a side view with a partial cutaway showing magnets in the top sleeve, and having a ball as the sealing plunger, the ball being made of a ferrous material such as stainless steel.

Referring next to FIG. 16 the top mechanism, also called sleeve 1600 has its lower segment 1601 shown in cutaway view to display magnets M which attract ball B. Ball B serves as the bottom mechanism as in FIGS. 13. 14, 15.

Although the present invention has been described with reference to various embodiments, numerous modifications and variations can be made and still the result will come within the scope of the invention. No limitation with respect to the specific embodiments disclosed herein is intended or should be inferred.

I claim:

1. A plunger for a hydrocarbon well producing through a production string, said plunger comprising:

at least two separable plunger sections, each of said sections movable independently downwardly in said well;

said sections being latchable at a bottom of said well to enable said sections to move in unison upwardly in said well;

said latchment causing a continuous mechanized mating between said sections during lift from said well bottom, thereby preventing accidental separation; and wherein said latchment is mechanically disengageable at a top of said well, thereby separating said sections to each commence a downward travel in said well and substantially in unison one with the other.

2. The plunger of claim 1, wherein said latchment comprises a magnetic coupling.

3. The plunger of claim 2, wherein one of said at least two sections further comprises an upper sleeve, and one of said at least two sections further comprises a lower plug, and wherein said lower plug comprises a magnet which couples said lower plug to an open end of said upper sleeve.

4. The plunger of claim 3, wherein said lower plug further comprises a non-magnetic isolator, thereby improving said magnetic coupling between said lower plug and said upper sleeve.

5. The plunger of claim 3, wherein said upper sleeve allows fluids to pass through its center in a downward travel in said well separately from said lower plug, and wherein said lower plug prevents said fluids from passing through said sleeve center while said plug is coupled to said upper sleeve during lift.

6. The plunger of claim 5, wherein said lower plug further comprises a ball made of ferrous material.

7. The plunger of claim 1, wherein said latchment comprises a mechanical coupling.

8. A multi-part, separable plunger assembly comprising:

a top mechanism comprising a female coupling means functioning to releasably secure a plug;

said plug mateable with the top mechanism coupling means to form a united plunger mechanism for upward movement in a well;

wherein said top mechanism comprises a bypass for fluids to pass through its center in a downward travel in the well separately from said mateable plug; and wherein said mateable plug prevents said fluids from passing through said top mechanism center while said plug is coupled to said top mechanism during lift.

9. The plunger assembly of claim 8, wherein said coupling means further comprises a mechanical pickup mechanism.

10. The plunger assembly of claim 9, wherein said pickup mechanism comprises a spring-loaded retaining ball coupleable with a mating groove housed on a top end of said plug.

11. The plunger assembly of claim 9, wherein said pickup mechanism comprises a spring-loaded retaining system latchable with a spherical plug sized for retention by said top mechanism.

12. The plunger assembly of claim 9, wherein said pickup mechanism comprises a retaining groove mateable with a compression ring housed on a top end of said plug.

13. The plunger assembly of claim 9, wherein said pickup mechanism comprises a flexible locking clamp system mateable with a top end of said plug.

14. The plunger assembly of claim 9, wherein said plug further comprises a ball retainable in a flexible locking clamp system.

15. The plunger assembly of claim 9, wherein said pickup mechanism comprises a compression ring retaining system latchable with a spherical plug sized for retention by said top mechanism.

16. The plunger assembly of claim 8, wherein said coupling means further comprises a magnetic latch mechanism.

17. The plunger assembly of claim 16, wherein said coupling means further comprises a magnet latchable with a spherical plug sized for retention by said top mechanism.

18. A multi-part, separable plunger assembly comprising:

a sleeve with an open end;

said open end further comprising construction from a ferrous material;

a plug having a top, said plug top coupleable to said open end;

said plug further comprising a magnet; and wherein said magnet couples said open end to said plug.

19. The plunger of claim 18, wherein said plug further comprises a top having a removable cap for securing said magnet in a hollow in a plug body.

20. The plunger of claim 19, wherein said hollow further comprises a non-magnetic isolator means functioning to radiate longitudinally a field of magnetic waves and improve a magnetic coupling between said plug and said open end.

21. A multi-part plunger apparatus for a hydrocarbon well, said apparatus comprising:

a discrete bottom mechanism geometrically designed to quickly travel to a well bottom;

a discrete top mechanism having a bypass for fluids to pass therethrough during a downward travel to a bottom of the well;

said bottom and top mechanisms being latchable on contact with each other at the bottom of the well, thereby forming a non-discrete plunger unit in a magnetically latched state to move upwardly in the well during lift without separation; and wherein said plunger unit is mechanically separated at a top of the well into said discrete bottom and top mechanisms.

22. The apparatus of claim 21, wherein said bottom mechanism further comprises a magnet encased in an end adjacent to the top mechanism, thereby forming a magnet end.

23. The apparatus of claim 22, wherein said top mechanism further comprises a ferromagnetic material to help produce a magnetic attraction to the magnet end of the bottom mechanism.

24. A multi-part, separable plunger assembly comprising:

a sleeve means having a bottom orifice, said sleeve means functioning to allow fluids to pass through its center and assist said sleeve means in falling against an upward well fluid flow;

a plug means functioning to prevent the fluids from passing through the center of said sleeve means while said plug means is inserted into said bottom orifice of said sleeve means; and a magnetic coupler means functioning to magnetically latch said sleeve means to said plug means.

25. The plunger assembly of claim 24, wherein said sleeve means comprises a magnet and said plug means comprises a ferrous material.

26. The plunger assembly of claim 24, wherein a top portion of said plug means comprises a magnet therein.

27. A multi-part, separable plunger assembly comprising:

a plunger sleeve comprising an open end having a mechanical coupler means functioning to releasably secure a top of a plug means; and said plug means functioning to mate with the sleeve mechanical coupler means and cause a closure of said open end, thereby preventing a bypass of fluids therethrough during plunger lift.

28. The plunger assembly of claim 27, wherein said plug means further comprises a ball sized for retention by said sleeve.

* * * * *